US006785918B2

(12) United States Patent
Romo

(10) Patent No.: US 6,785,918 B2
(45) Date of Patent: Sep. 7, 2004

(54) SINK CLIP ASSEMBLY

(75) Inventor: Mark A. Romo, Paw Paw, MI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/334,215

(22) Filed: Dec. 30, 2002

(65) Prior Publication Data

US 2003/0154546 A1 Aug. 21, 2003

Related U.S. Application Data

(60) Provisional application No. 60/344,849, filed on Dec. 31, 2001.

(51) Int. Cl.[7] ..... E03C 1/33
(52) U.S. Cl. ..... 4/634; 4/633
(58) Field of Search ..... 4/633, 634; 312/140.4

(56) References Cited

U.S. PATENT DOCUMENTS

| | | | | |
|---|---|---|---|---|
| 2,817,097 A | | 12/1957 | Henley, Jr. | |
| 2,883,677 A | | 4/1959 | Geen | |
| 2,973,524 A | | 3/1961 | Daniels | |
| 2,992,436 A | | 7/1961 | Camp | |
| 3,008,149 A | | 11/1961 | Eynon | |
| 3,029,445 A | | 4/1962 | Just | |
| 3,029,446 A | | 4/1962 | Just | |
| 3,034,141 A | | 5/1962 | Lyon | |
| 3,191,191 A | | 6/1965 | Juergens | |
| 3,613,128 A | | 10/1971 | Moyer | |
| 3,813,707 A | | 6/1974 | Fowell | |
| 4,432,106 A | | 2/1984 | Smith | |
| 4,504,986 A | | 3/1985 | Vigh | |
| 4,589,170 A | | 5/1986 | Ponting | |
| 4,613,995 A | | 9/1986 | Ricke | |
| 5,664,265 A | * | 9/1997 | Gotter et al. | 4/634 |
| 5,903,936 A | | 5/1999 | Kato | |
| 6,216,992 B1 | | 4/2001 | Bisonaya et al. | |

OTHER PUBLICATIONS

FHP, FHP Technology That Dominates; advertisement; admitted prior art;Circle No. 17; FHP, Ruston, Louisiana, 1 pg.

Photograph of sample of FHP sink attachment clip; admitted prior art, 1 pg.

* cited by examiner

*Primary Examiner*—Robert M. Fetsuga
(74) *Attorney, Agent, or Firm*—Quarles & Brady LLP

(57) ABSTRACT

An assembly for mounting a kitchen sink to a counter top provides a sink rim with a substantially horizontally extending bent back wall. A clip assembly for use therewith has a bracket with a grip region defining a horizontal gap sized to fit snugly around an edge of the horizontal wall. The bracket defines a pair of vertical tracks in which vertical extensions of a clamp member can slide. The L-shaped clamp has a generally horizontal hook that can engage the underside of the counter top so as to clamp the sink to the counter top by tightening a threaded fastener.

8 Claims, 3 Drawing Sheets

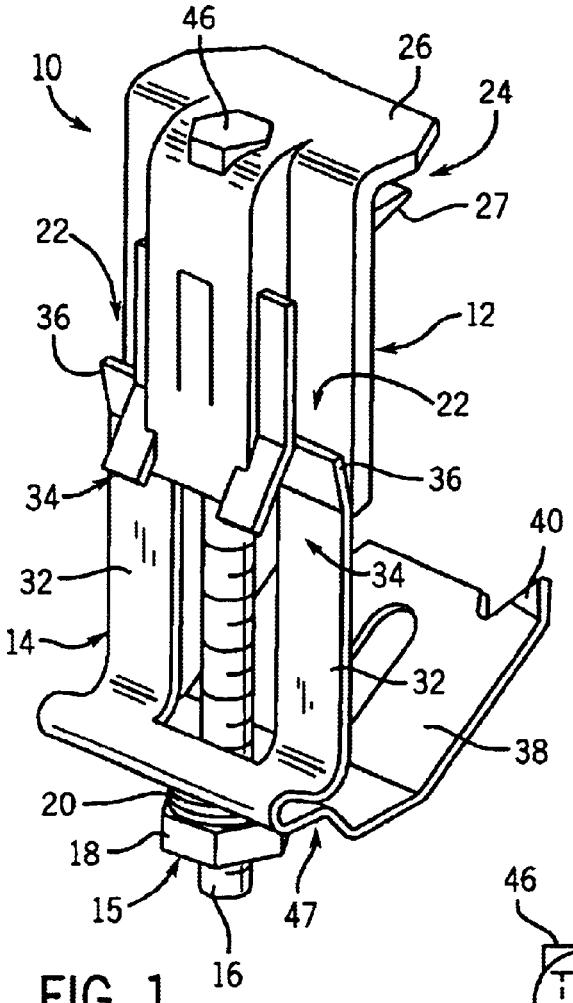
FIG. 1
FIG. 2
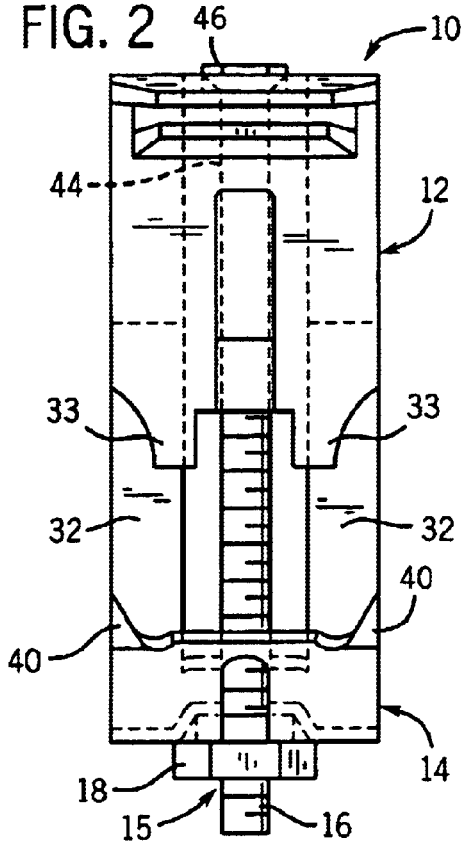
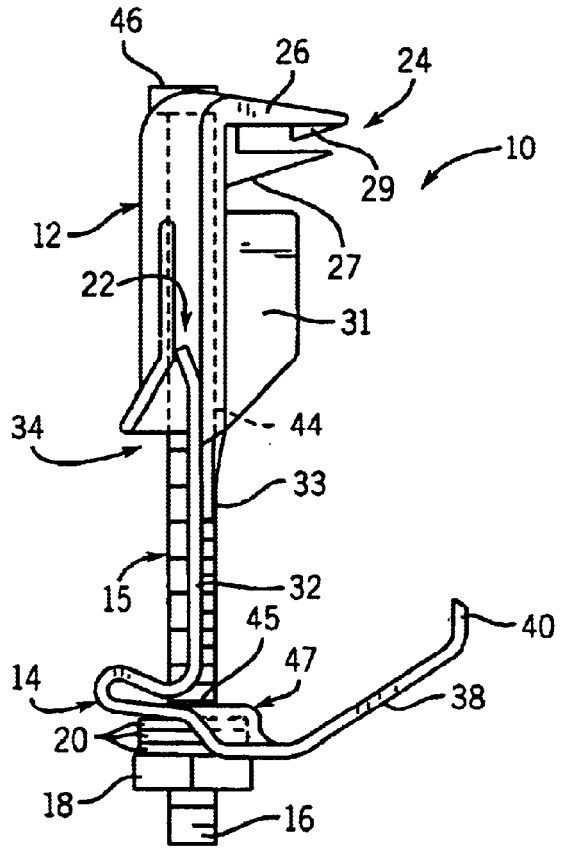
FIG. 3

FIG. 4
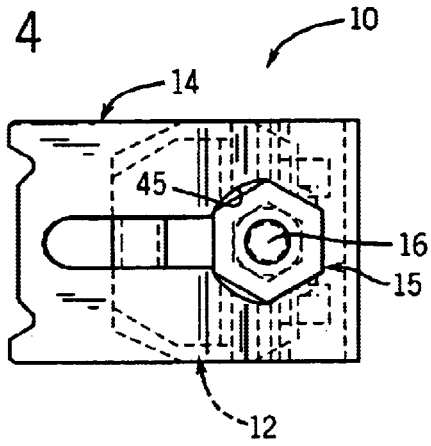
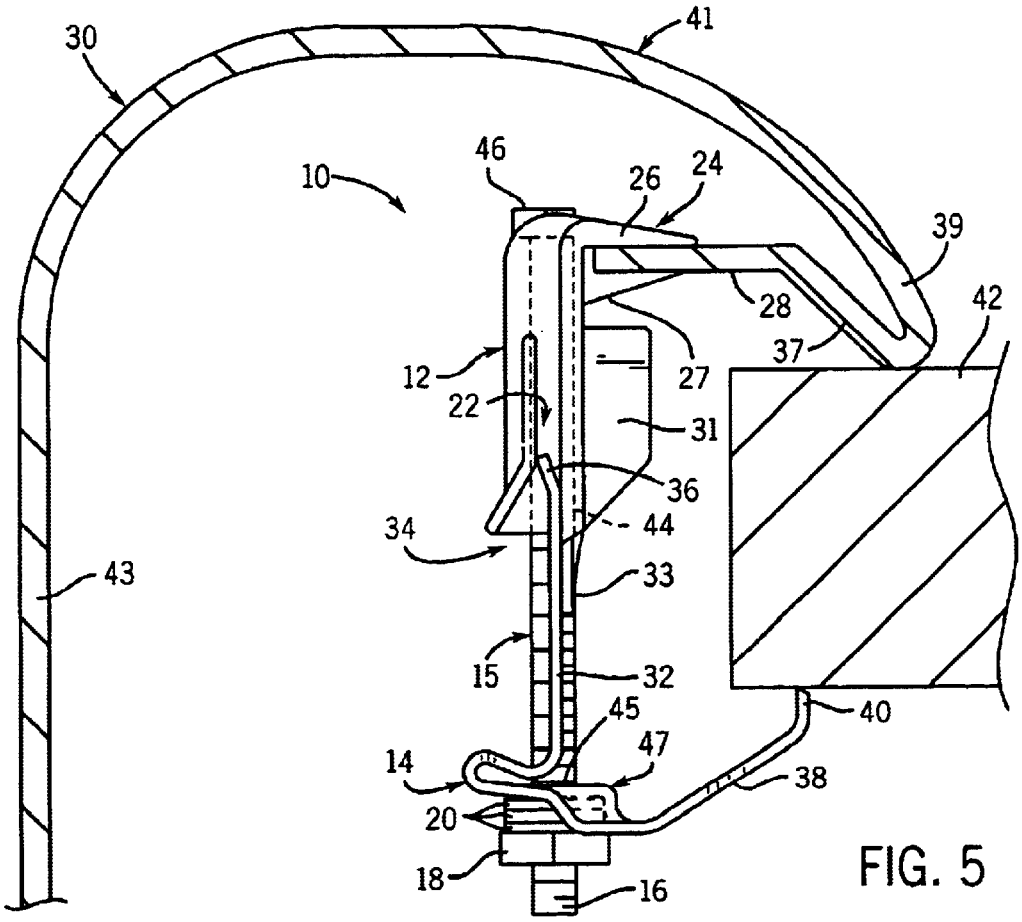
FIG. 5

SINK CLIP ASSEMBLY

CROSS-REFERENCE TO RELATED APPLICATION

This application claims priority to U.S. provisional application Ser. No. 60/344,849, filed Dec. 31, 2001.

STATEMENT OF FEDERALLY SPONSORED RESEARCH OR DEVELOPMENT

Not applicable.

BACKGROUND OF THE INVENTION

The present invention relates to mounting assemblies for plumbing fixtures, and in particular clip assemblies for mounting kitchen sinks to counter tops.

Various clip systems have been developed to clamp sinks to a counter top through installation openings in counter tops. Typically, to avoid having to drill multiple holes (apart from the main basin hole) in the counter top, clips are provided with one end of each clip being attached to the underside of the sink rim and the other end of each clip engaging an underside of the counter top to provide a clamping force. See e.g. U.S. Pat. Nos. 5,903,936, 4,613,995, 4,504,986, 4,432,106, 3,813,707, 3,191,191, 3,034,141, 3,029,446, 3,029,445, 3,008,149, 2,992,436, 2,883,677, and 2,817,097. See also German publications 1,500,636, 2,608,962, and 2,755,972.

Many prior art clip systems rely on a clamping device such as a bolt end which contacts the counter top bottom in only a small area. As a result, to provide a secure connection, more of the clips must be arrayed around the sink rim.

Also, many prior art clip systems cannot be securely pre-assembled to the sink before the sink basins are lowered through the counter top hole. Thus, most of the assembly must be performed in cramped and dark spaces, below the sink.

Still other systems require modifications to the sink underside which increase the manufacturing cost, or complex clip assemblies which similarly have increased costs, or require installation techniques which are more likely to require use of a professional plumber. Stainless steel sinks serve the lowest cost end of the sink market. This is a market segment that is extremely price sensitive.

Thus, it can be seen that a need still exists to provide improved sink clip assemblies, particularly those which minimize the amount of work needed below the counter top in connection with stainless steel sinks, without significantly increasing the costs of production or installation.

SUMMARY OF THE INVENTION

In one aspect the invention provides a sink clip assembly. It has a bracket with an axially extending track and a grip region defined by laterally extending mouth. There is also a clamp having an axially extending spine mountable to ride along the track and a laterally extending clamping hook. A fastener is also provided. Upon rotation of at least a portion thereof, the fastener can drive the spine along the track.

In preferred forms the fastener includes a bolt mounted through both the bracket and clamp. It also includes a nut rotatably threaded on the bolt. Rotation of the nut moves the nut axially along the bolt and also drives the clamp axially. The bolt preferably has a head that fits in a recess in the bracket such that the recess restricts rotation of the bolt. In a particularly preferred form, the axial direction is an essentially vertical direction, and the lateral direction is an essentially horizontal direction.

The mouth can be defined by a pair of upper and lower lips that are spaced apart, the lower of which is made of a flexible material. The lower lip can also be of a lesser thickness than the upper lip, and one of the lips can have a tooth extending into the mouth.

In the most preferred form, there are two such tracks and two such spines.

In another aspect the invention provides a sink assembly. There is a sink having a basin, an upper outer rim around the basin, and a lower outer rim positioned below at least a portion of the upper outer rim and extending essentially horizontally adjacent its terminal portion. There is also a clip assembly of the type described above for use therewith.

The present invention thus provides an assembly for mounting a sink to a counter top. Fastening clips can be securely pre-positioned onto the sink rim before the sink basin is lowered into the installation opening. Due to the mouth gripping on the rim horizontal extension, the clips grip onto the horizontally extending wall of the sink rim so that they do not readily fall off. This can be achieved even where the rim is not all the way into the mouth (so that the clamps will clear the counter opening).

Once the sink basin extends below the counter top, the brackets can be pushed further laterally outward such that the hooks become trapped under the counter top. The rim can then be easily secured to the counter top by tightening the nuts (e.g. with a conventional power driver). This assembly thereby minimizes the work to be performed from beneath the counter top.

It should be noted that each clip provides clamping force across more than one half inch due to the spaced hook members, thereby requiring fewer of the clips for any given amount of clamping security. Moreover, the clamping force will not dislodge the sink rim from the mouth as the clamping force is totally transverse to the mouth opening.

The construction is relatively inexpensive to create, yet is capable of withstanding extensive stresses.

These and other advantages of the invention will be apparent from the detailed description and drawings.

BRIEF DESCRIPTION OF THE DRAWINGS

FIG. 1 is a top, left perspective view of a sink clip assembly of the present invention;

FIG. 2 is a right side elevational view of the FIG. 1 sink clip assembly;

FIG. 3 is a front elevational view of the sink clip assembly of FIG. 1;

FIG. 4 is a bottom view of the sink clip assembly of FIG. 1;

FIG. 5 is a front view, partially in section with respect to the sink rim, showing a preferred sink assembly using the FIG. 1 clip assembly;

DETAILED DESCRIPTION OF THE PREFERRED EMBODIMENTS

Figure 6:
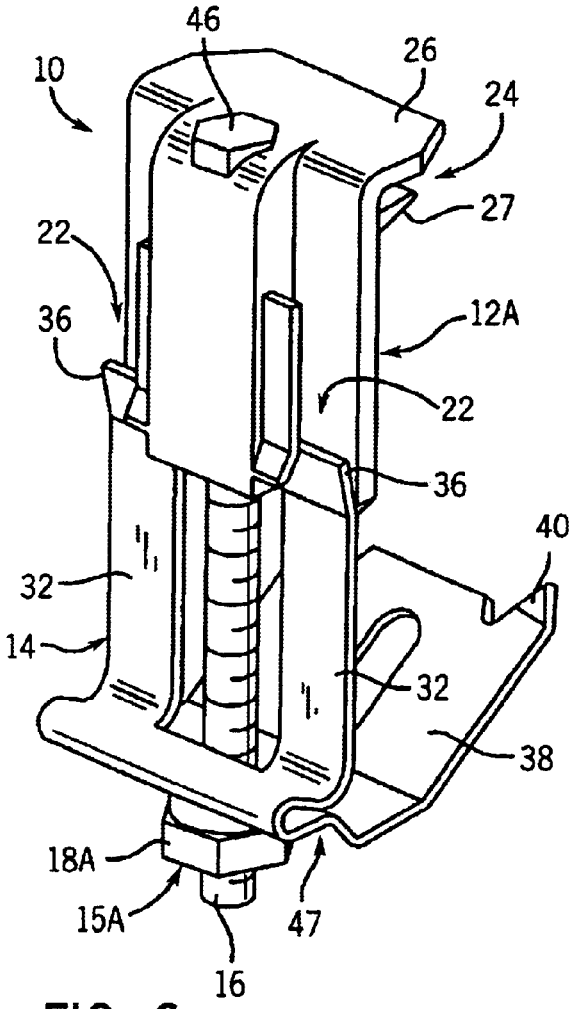
FIG. 6 is a top, left perspective view of a slightly varied construction of the sink clip assembly of the present invention.

The present invention provides a sink clip assembly 10 having a bracket 12, a clamp 14, and a fastener 15 including a bolt 16 and a nut 18. The bolt 16 is preferably a hex-head bolt to which a nut 18 is rotatably threaded. There may also be one or more washers 20 (one is visible in FIG. 1 and three are visible in FIG. 3) under the nut 18.

The bracket 12 is a rigid, preferably plastic molded, generally upside down L-shaped part defining a pair of vertical tracks 22 along its left side and a flexible gripper mouth 24 extending from the opposite side. The mouth 24 includes a pair of horizontal upper 26 and lower 27 lips spaced apart to define a narrow gap that receives a generally horizontal hanger wall 28 at the terminal end of a lower outer rim part 37 which is underneath an upper outer rim part 39 of a sink rim 41 extending integrally about a basin 43 of a sink 30.

The hanger wall 28 is preferably a unitary part of the sink formed by bending the rim backward and under the primary sink rim so as to extend inwardly essentially horizontally. The gap and the wall 28 are sized so that the mouth 24 can be jammed part way over the wall 28 such that the clips can be pre-positioned on the sink without easily falling off when the sink is moved during installation, yet not so much that the hook 38 would interfere with the counter top as the basin is lowered through the counter top opening.

The upper jaw 26 is rigid and preferably formed with a tooth 29 (see FIG. 3) extending downwardly somewhat into the gap to further increase the grip. The lower lip 27 is preferably thinner then the upper lip 26 so to be much more readily deflected when attaching the clip to the hanger wall 28. In fact, the upper lip should be sufficiently rigid so as not to deform under clamping pressure.

The body 12 also includes a vertical section 31 increasing the rigidity of the body 12. Tapered bottom ends 33 provide stops limiting upward movement of the clamp 14.

The clamp 14 is a metal L-shaped claw-like structure with two vertical extensions or spines 32 that ride within the tracks 22. The tracks 22 are wider than the spines 32 and have entries 34 to facilitate inserting and sliding of the spines 32 within the tracks 22. The ends 36 of the spines 32 are bent to facilitate coupling with the tracks 22, and hold the clamp 14. The clamp 14 also has a somewhat upwardly directed hook 38 with two toes 40 at one end to bite into the under side of counter top 42 when the clip assembly 10 is tightened by tightening the nut 18.

The bolt 16 fits through an axial bore 44 in the body and extends down through an opening 45 in a base section 47 of the clamp 14. Hexagonal head 46 of the bolt 16 fits into a correspondingly shaped recess in the top of the body 12 to prevent the bolt 16 from turning when the nut 18 (and optionally one or more washers 20) are placed onto the bolt 16, and the nut 18 is rotated.

Tightening the nut 18 moves it up on the bolt, and thus drives the clamp 14 upward so that the spines 32 slide up in the tracks 22. The hooks thereby clamp the sink to the counter top 42. Note also that the clip assembly is suitable to secure the sink to counter tops of various thicknesses.

Figure 7:
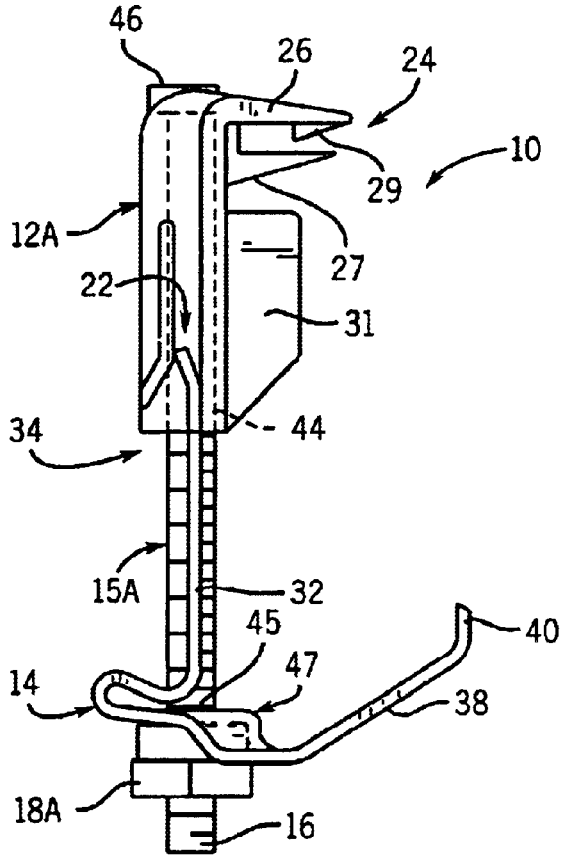
FIG. 7 is a front elevational view of the sink clip assembly of FIG. 6.

FIGS. 6 and 7 show another embodiment of the invention differing only slightly from the above described embodiment. As such, the same reference numerals will be shown in these figures to refer to the elements of this embodiment that are as described above. Elements with altered constructions will have similar reference numbers as the components above albeit with the suffix "A".

The only differences between the two constructions, is that the washers 20 in the first embodiment have been replaced by a barreled nut 18A in fastener 15A and the bracket element has a slightly different construction. In particular, the bracket 12A is formed without the downwardly extending stop elements 33 of the above described embodiment and the lower angled ends of the two tracks 22 are slightly truncated.

Preferred embodiments of the invention have been described above. However, a number of modifications and variations will be apparent to those skilled in the art, which will be within the spirit and scope of the invention.

For example, the vertical bore in the clamp could be threaded so that rotation of the bolt drives the clamp. In such an embodiment the bracket recess should allow rotation. Alternatively, it is not required that there by two spines and two hooks. One of each will suffice. However, it is highly preferred that there by two of each, with about one half inch of spacing between them.

Therefore, the invention should not be limited to just the described embodiments. To ascertain the full scope of the invention, the following claims should be referenced.

INDUSTRIAL APPLICABILITY

The invention provides an improved clip assembly, and an improved sink assembly, facilitating mounting a sink to a counter top.

I claim:

1. A sink clip assembly, comprising:

a bracket having an axially extending track and a grip region defined by laterally extending mouth having a pair of spaced apart lips;

a clamp having an axially extending spine mountable to ride along the track and a laterally extending clamping hook; and a fastener that upon rotation of at least a portion thereof can drive the spine along the track;

wherein the fastener comprises a bolt mounted through both the bracket and clamp, and a nut rotatably threaded on the bolt, whereby rotation of the nut can move the nut axially along the bolt and also drive the clamp axially.

2. The sink clip assembly of claim 1, wherein the bolt has a head that fits in a recess in the bracket such that the recess can restrict rotation of the bolt.

3. The sink clip assembly of claim 1, wherein said axial direction is an essentially vertical direction and said lateral direction is an essentially horizontal direction.

4. The sink clip assembly of claim 1, wherein the mouth is defined by a pair of upper and lower lips that are spaced apart, at least one of which is made of a flexible material.

5. A sink clip assembly, comprising:

a bracket having an axially extending track and a grip region defined by laterally extending mouth;

a clamp having an axially extending spine mountable to ride along the track and a laterally extending clamping hook; and a fastener that upon rotation of at least a portion thereof can drive the spine along the track;

wherein the mouth is defined by a pair of upper and lower lips that are spaced apart, at least one of which is made of a flexible material and wherein the lower lip is of a lesser thickness than the upper lip.

6. The sink clip assembly of claim 5, wherein one of the lips has a tooth extending into the mouth.

7. The sink assembly of claim 5, wherein there are two such tracks and two such spines.

8. A sink assembly, comprising:

a sink having a basin with an integral rim having an upper rim part around the basin and a lower rim part positioned below at least a portion of the upper rim part and extending essentially horizontally adjacent its terminal portion; and a clip assembly having:

a bracket having an axially extending track and a grip region defined by laterally extending mouth having a pair of spaced apart lips defining a gap receiving at least part of the terminal portion of the lower rim part;

a clamp having an axially extending spine mountable to ride along the track and a laterally extending clamping hook; and a fastener that upon rotation of at least a portion thereof can drive the spine along the track;

wherein rotation of said portion can drive the hook towards the sink rim.

* * * * *